US011242593B2

(12) United States Patent
Ihara et al.

(10) Patent No.: US 11,242,593 B2
(45) Date of Patent: Feb. 8, 2022

(54) STEEL FOR NITROCARBURIZING, AND COMPONENT

(71) Applicant: JFE STEEL CORPORATION, Chiyoda-ku Tokyo (JP)

(72) Inventors: Naoya Ihara, Tokyo (JP); Masayuki Kasai, Tokyo (JP); Takashi Iwamoto, Tokyo (JP); Kimihiro Nishimura, Tokyo (JP)

(73) Assignee: JFE STEEL CORPORATION, Chiyoda-ku Tokyo (JP)

( * ) Notice: Subject to any disclaimer, the term of this patent is extended or adjusted under 35 U.S.C. 154(b) by 96 days.

(21) Appl. No.: 16/464,374

(22) PCT Filed: Nov. 30, 2017

(86) PCT No.: PCT/JP2017/043211

§ 371 (c)(1),
(2) Date: May 28, 2019

(87) PCT Pub. No.: WO2018/101451

PCT Pub. Date: Jun. 7, 2018

(65) Prior Publication Data

US 2020/0149148 A1 May 14, 2020

(30) Foreign Application Priority Data

Nov. 30, 2016 (JP) ..... JP2016-233423

(51) Int. Cl.

| | |
|---|---|
| ***C23C 8/32*** | (2006.01) |
| ***C21D 1/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C22C 38/60*** | (2006.01) |

(52) U.S. Cl.

CPC ..... *C23C 8/32* (2013.01); *C21D 1/06* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/32* (2013.01); *C22C 38/60* (2013.01); *C21D 2211/001* (2013.01); *C21D 2211/004* (2013.01)

(58) Field of Classification Search

CPC ..... C23C 8/32; C21D 1/06; C22C 38/008; C22C 38/001; C22C 38/60; C22C 38/38; C22C 38/12; C22C 38/04; C22C 38/10; C22C 38/02; C22C 38/06; C22C 38/08; C22C 38/14; C22C 38/16; C22C 38/32

See application file for complete search history.

(56) References Cited

U.S. PATENT DOCUMENTS

| | | | |
|---|---|---|---|
| 8,876,988 | B2 | 11/2014 | Chida et al. |
| 9,718,256 | B2 | 8/2017 | Gyotoku et al. |
| 10,125,416 | B2 | 11/2018 | Omori et al. |
| 2015/0020926 | A1 | 1/2015 | Iwamoto et al. |
| 2015/0027591 | A1 | 1/2015 | Gyotoku et al. |
| 2015/0159261 | A1 | 6/2015 | Omori et al. |
| 2018/0105919 | A1 | 4/2018 | Kasai et al. |

FOREIGN PATENT DOCUMENTS

| | | | |
|---|---|---|---|
| CN | 104114733 | A | 10/2014 |
| CN | 104508164 | A | 4/2015 |
| EP | 2816128 | A1 | 12/2014 |
| EP | 2878695 | A1 | 6/2015 |
| JP | H0559488 | A | 3/1993 |
| JP | 2000282175 | A | 10/2000 |
| JP | 2002069572 | A | 3/2002 |
| JP | 2008202115 | A | 9/2008 |
| JP | 2010163671 | A | 7/2010 |
| JP | 5567747 | B2 | 8/2014 |
| JP | 2016056451 | A | 4/2016 |
| KR | 1020140129081 | A | 11/2014 |
| WO | 2012067181 | A1 | 5/2012 |
| WO | 2013121794 | A1 | 8/2013 |
| WO | 2013140869 | A1 | 9/2013 |
| WO | 2014017074 | A1 | 1/2014 |
| WO | 2016152167 | A1 | 9/2016 |

OTHER PUBLICATIONS

ASM International, Materials Park, Ohio, ASM Handbook vol. 1: Hardenability of carbon and low-alloy steels, pp. 464-483, Mar. 1990.*

ASM International, Materials Park, Ohio, ASM Handbook vol. 1: Hardenability of carbon and low-alloy steels, pp. 144-147, Mar. 1990.*

Jul. 2, 2019, Notification of Reasons for Refusal issued by the Japan Patent Office in the corresponding Japanese Patent Application No. 2018-554271 with English language concise statement of relevance.

Sep. 25, 2020, Office Action issued by the Korean Intellectual Property Office in the corresponding Korean Patent Application No. 10-2019-7015288 with English language concise statement of relevance.

(Continued)

*Primary Examiner* — Jessee R Roe

(74) *Attorney, Agent, or Firm* — Kenja IP Law PC

(57) ABSTRACT

Provided is a steel for nitrocarburizing that can ensure hardened case depth by suppressing precipitation of Cr, V, and Nb in a part of the surface layer very close to the surface. The provided steel comprises: a specific chemical composition satisfying $9.5 \leq ([Cr]/52+[V]/50.9+[Nb]/92.9+M) \times 10^3 \leq 18.5$, with the balance being Fe and inevitable impurities; and a steel microstructure in which an area ratio of bainite phase with respect to the entire microstructure is more than 50%.

18 Claims, 3 Drawing Sheets

(56) References Cited

OTHER PUBLICATIONS

Nov. 7, 2019, the Extended European Search Report issued by the European Patent Office in the corresponding European Patent Application No. 17875706.8.
Jul. 27, 2020, Office Action issued by the China National Intellectual Property Administration in the corresponding Chinese Patent Application No. 201780073733.X with English language concise statement of relevance.
Mar. 6, 2018, International Search Report issued in the International Patent Application No. PCT/JP2017/043211.
Mar. 30, 2021, Office Action issued by the China National Intellectual Property Administration in the corresponding Chinese Patent Application No. 201780073733.X with English language concise statement of relevance.

* cited by examiner

STEEL FOR NITROCARBURIZING, AND COMPONENT

TECHNICAL FIELD

The present disclosure relates to steel for nitrocarburizing, and is intended to provide steel for nitrocarburizing that has certain machinability by cutting before nitrocarburizing treatment and can obtain excellent fatigue resistance after the nitrocarburizing treatment and that is suitable for use in components of vehicles and construction machines. The present disclosure also relates to a component obtainable by subjecting the steel for nitrocarburizing to nitrocarburizing treatment.

BACKGROUND

Machine structural components such as automobile gears are required to have excellent fatigue resistance, and thus are usually subjected to surface hardening treatment. As such surface hardening treatment, carburizing treatment, induction quench hardening treatment, nitriding treatment, and the like are well known.

Carburizing treatment is a process of infiltrating and diffusing C in a high-temperature austenite region, so that deep case depth is obtained. Carburizing treatment is thus effective in improving fatigue resistance. However, since carburizing treatment causes heat treatment distortion, it is difficult to apply carburizing treatment to components that, from the perspective of noise or the like, require high dimensional accuracy.

Induction quench hardening treatment is a process of quenching the surface layer by high frequency induction heating, which causes heat treatment distortion, too. Induction quench hardening treatment is therefore problematic in terms of dimensional accuracy, as with carburizing treatment.

Nitriding treatment is a process of infiltrating and diffusing nitrogen in a relatively low temperature range not higher than $Ac_1$ transformation temperature, to increase surface hardness. With nitriding treatment, there is no possibility of heat treatment distortion mentioned above. However, nitriding treatment takes a long treatment time of 50 hr to 100 hr, and requires removal of a brittle compound layer in the surface layer after the treatment.

In view of this, nitrocarburizing treatment with approximately the same treatment temperature as and shorter treatment time than nitriding treatment has been developed and widely used for machine structural components and the like in recent years. Nitrocarburizing treatment is a process of infiltrating and diffusing N and C simultaneously in a temperature range of 500° C. to 600° C. to harden the surface, and can reduce the treatment time by more than half as compared with the conventional nitriding treatment.

However, while carburizing treatment can increase core hardness by quench hardening, core hardness does not increase with nitrocarburizing treatment because the treatment is performed at a temperature of not higher than the transformation temperature of steel. This causes lower fatigue resistance of nitrocarburized material than carburized material.

To enhance the fatigue resistance of nitrocarburized material, quenching-tempering treatment is typically performed before nitrocarburizing treatment to increase core hardness. The resultant fatigue resistance is, however, insufficient. Besides, production costs increase, and machinability decreases inevitably.

To solve such problems, JP H5-59488 A (PTL 1) proposes a steel for nitrocarburizing that contains Ni, Cu, Al, Cr, Ti, and the like to achieve high bending fatigue resistance after nitrocarburizing treatment. By subjecting the steel to nitrocarburizing treatment, the core is age-hardened by Ni—Al and Ni—Ti intermetallic compounds or Cu compounds, and the surface layer is hardened by precipitating nitrides or carbides of Cr, Al, Ti, and the like in the nitrided layer, thus improving bending fatigue resistance.

JP 2002-69572 A (PTL 2) proposes a steel for nitrocarburizing that contains 0.5% to 2% Cu and is extend-forged by hot forging and then air-cooled to form a microstructure mainly composed of ferrite in which Cu is dissolved. Nitrocarburizing treatment at 580° C. for 120 min causes precipitation hardening by Cu and also precipitation hardening by Ti, V, and Nb carbonitrides, to achieve excellent bending fatigue resistance after the nitrocarburizing treatment.

JP 2010-163671 A (PTL 3) proposes a steel for nitrocarburizing in which Ti—Mo carbides and carbides containing these elements and further containing one or more of Nb, V, and W are dispersed.

JP 5567747 B2 (PTL 4) proposes a steel material for nitriding that contains V and Nb and whose microstructure before nitriding is mainly composed of bainite so that the precipitation of V and Nb carbonitrides is suppressed before nitriding and induced during the nitriding, thus achieving excellent fatigue resistance with improved core hardness.

CITATION LIST

Patent Literatures

PTL 1: JP H5-59488 A
PTL 2: JP 2002-69572 A
PTL 3: JP 2010-163671 A
PTL 4: JP 5567747 B2

SUMMARY

Technical Problem

However, the steel for nitrocarburizing described in PTL 1 improves bending fatigue resistance by precipitation hardening by Ni—Al and Ni—Ti intermetallic compounds, Cu, and the like, but does not ensure sufficient workability. The steel for nitrocarburizing described in PTL 2 requires high production costs, because Cu, Ti, V, and Nb need to be added in relatively large amounts. The steel for nitrocarburizing described in PTL 3 is also costly, because Ti and Mo need to be added in large amounts in order to form sufficient fine precipitates.

The steel material for nitriding described in PTL 4 contains Cr, V, and Nb, for precipitation hardening of the nitrided layer. These elements are effective in hardening the nitrided layer. However, in the case where these elements are added excessively, precipitation hardening occurs only in a part of the surface layer very close to the surface, and the hardened case is formed only in a shallow part in the surface layer.

It could therefore be helpful to provide a steel for nitrocarburizing that can ensure hardened case depth by suppressing precipitation of Cr, V, and Nb in a part of the surface layer very close to the surface. It could also be helpful to provide a component having improved fatigue resistance by increasing core hardness as a result of nitrocarburizing treatment after machining.

Solution to Problem

Through intensive study on the influences of the chemical composition and microstructure of steel, we discovered the following: Steel that has a chemical composition containing a relatively large amount of inexpensive C and appropriate amounts of Cr, V, and Nb and a microstructure including bainite phase in an area ratio of more than 50% can ensure excellent machinability because precipitation of Cr, V, and Nb is suppressed. Moreover, in a nitrocarburized component obtained as a result of nitrocarburizing treatment on the steel, fine precipitates containing Cr, V, and Nb are dispersion-precipitated in the core, so that core hardness increases and excellent fatigue resistance is obtained. Further, with appropriate contents of Cr, V, Nb, W, Co, Hf, Zr, and Ti, carbonitride forming elements which prevent N and C from diffusing inwardly from the surface during nitrocarburizing treatment decrease, and the thickness of the hardened case formable by nitrocarburizing treatment increases, which contributes to higher surface fatigue strength.

The present disclosure is based on these discoveries and further studies. We thus provide:

1. A steel for nitrocarburizing, comprising:

a chemical composition containing (consisting of), in mass %,

C: 0.010% or more and 0.100% or less,
Si: 1.00% or less,
Mn: 0.50% or more and 3.00% or less,
P: 0.020% or less,
S: 0.060% or less,
Cr: 0.30% or more and 0.90% or less,
Mo: 0.005% or more and 0.200% or less,
V: 0.02% or more and 0.50% or less,
Nb: 0.003% or more and 0.150% or less,
Al: 0.005% or more and 0.200% or less,
N: 0.0200% or less,
Sb: 0.0005% or more and 0.0200% or less,
W: 0.3% or less inclusive of 0%,
Co: 0.3% or less inclusive of 0%,
Hf: 0.2% or less inclusive of 0%, and
Zr: 0.2% or less inclusive of 0%, and
Ti: 0.1% or less inclusive of 0%, with the balance being Fe and inevitable impurities; and a steel microstructure in which an area ratio of bainite phase with respect to the entire microstructure is more than 50%, wherein the chemical composition satisfies the following Formula (1):

$$9.5 \leq ([Cr]/52+[V]/50.9+[Nb]/92.9+M)\times 10^3 \leq 18.5 \quad (1)$$

where M is a sum total of [W]/183.8, [Co]/58.9, [Hf]/178.5, [Zr]/91.2, and [Ti]/47.9, and parentheses [ ] represent a content of a corresponding element in the parentheses in mass %.

2. The steel for nitrocarburizing according to 1., wherein the chemical composition further contains, in mass %, one or more selected from the group consisting of B: 0.0100% or less,
Cu: 0.3% or less, and
Ni: 0.3% or less.

3. The steel for nitrocarburizing according to 1. or 2., wherein the chemical composition further contains, in mass %, one or more selected from the group consisting of Pb: 0.2% or less,
Bi: 0.2% or less,
Zn: 0.2% or less, and
Sn: 0.2% or less.

4. A component comprising:

a core having the chemical composition and the steel microstructure according to any of 1. to 3.; and a surface layer having a chemical composition in which contents of nitrogen and carbon are higher than in the chemical composition of the core, wherein Cr-containing precipitates, V-containing precipitates, and Nb-containing precipitates are dispersion-precipitated in the bainite phase.

Advantageous Effect

It is thus possible to provide a steel for nitrocarburizing excellent in machinability with an inexpensive chemical composition. By subjecting the steel for nitrocarburizing to nitrocarburizing treatment, a component according to the present disclosure having fatigue resistance higher than or equal to that of JIS SCr420 material subjected to carburizing treatment can be obtained. The steel for nitrocarburizing according to the present disclosure is therefore very useful as raw material for producing machine structural components of vehicles and the like. The component according to the present disclosure is very useful as machine structural components of vehicles and the like.

DETAILED DESCRIPTION

Figure 1:
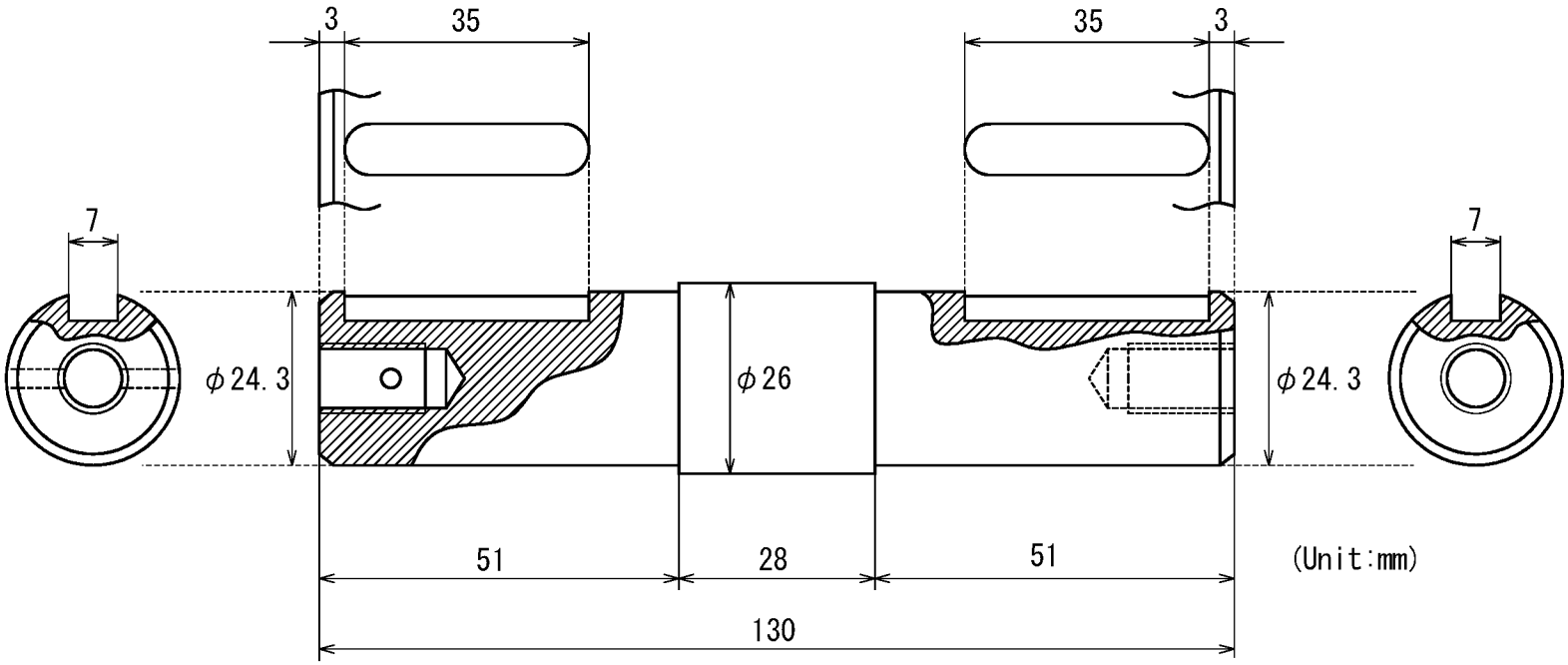
FIG. 1 is a diagram illustrating a roller pitching test piece.

Detailed description will be given below.

The reasons for limiting the chemical composition to the foregoing range in the present disclosure will be described below. Herein, "%" representing the chemical composition denotes "mass %" unless otherwise specified.

C: 0.010% or more and 0.100% or less

C is necessary to form bainite phase (described later) and ensure strength. If the C content is less than 0.010%, a sufficient amount of bainite phase cannot be obtained, and also the amounts of V and Nb precipitates after nitrocarburizing treatment are insufficient, which makes it difficult to ensure strength. The C content is therefore limited to 0.010% or more. If the C content is more than 0.100%, the hardness of the bainite phase formed increases, and machinability decreases. The C content is therefore limited to 0.010% or more and 0.100% or less. The C content is preferably 0.060% or more and 0.090% or less.

Si: 1.00% or less

Si is effective in not only deoxidation but also bainite phase formation. If the Si content is more than 1.00%, Si dissolves in ferrite and bainite phases, and causes solid solution hardening to thus decrease machinability and cold workability. The Si content is therefore limited to 1.00% or less. The Si content is preferably 0.50% or less, and more preferably 0.30% or less. For effective contribution to deoxidation, the Si content is preferably 0.010% or more.

Mn: 0.50% or more and 3.00% or less

Mn has an effect of enhancing the quench hardenability of the steel and enabling stable formation of bainite phase. Mn also improves bending impact resistance which is important for automotive components. In general, an effective way of enhancing fatigue resistance is to increase the C content and enhance core hardness in the component (hereafter referred to as "core hardness"). Simply increasing the C content, however, causes a decrease in bending impact resistance. If the Mn content is 0.50% or more, such a decrease in bending impact resistance caused by increasing the C content can be prevented. If the Mn content is less than 0.50%, this effect is insufficient. Besides, the amount of MnS formed is insufficient, so that machinability by cutting decreases. The Mn content is therefore limited to 0.50% or more. If the Mn content is more than 3.00%, machinability and cold workability decrease. The Mn content is therefore limited to 3.00% or less. The Mn content is preferably 1.50% or more and 2.50% or less, and more preferably 1.50% or more and 2.00% or less.

P: 0.020% or less

P is an element that enters into the steel as an impurity, and segregates to austenite grain boundaries and decreases grain boundary strength, thus causing lower strength and toughness. Hence, the P content is desirably as low as possible, yet up to 0.020% P is allowable. Reducing the P content to less than 0.001% requires high costs, and accordingly the P content may be 0.001% or more in industrial terms.

S: 0.060% or less

S is an element that enters into the steel as an impurity. If the S content is more than 0.060%, the toughness of the steel decreases. The S content is therefore limited to 0.060% or less. The S content is preferably 0.040% or less. Meanwhile, S is useful as it forms MnS in the steel and improves machinability by cutting. To achieve the effect of improving machinability by cutting by S, the S content is preferably 0.002% or more.

Cr: 0.30% or more and 0.90% or less

Cr is added as it is effective in bainite phase formation. If the Cr content is less than 0.30%, the amount of bainite phase formed is insufficient, and V and Nb precipitates form before nitrocarburizing treatment, so that the hardness before nitrocarburizing increases. Besides, the absolute amounts of V and Nb precipitates after nitrocarburizing treatment decrease, so that the hardness after nitrocarburizing treatment decreases. This makes it difficult to ensure strength. The Cr content is therefore limited to 0.30% or more. If the Cr content is more than 0.90%, the effective hardened case depth decreases, as described later. The Cr content is therefore limited to 0.90% or less. The Cr content is preferably in a range of 0.50% to 0.90%.

Mo: 0.005% or more and 0.200% or less

Mo has an effect of finely precipitating V and Nb precipitates and improving the strength of the nitrocarburized material, and is an important element in the present disclosure. Mo is also effective in bainite phase formation. To improve the strength, the Mo content needs to be 0.005% or more. However, since Mo is an expensive element, the component cost increases if the Mo content is more than 0.200%. The Mo content is therefore limited to a range of 0.005% to 0.200%. The Mo content is preferably in a range of 0.010% to 0.200%, and more preferably in a range of 0.040% to 0.200%.

V: 0.02% or more and 0.50% or less

V is an important element that, as a result of a temperature increase in nitrocarburizing, forms fine precipitates with Nb and increases core hardness, thus improving strength. If the V content is less than 0.02%, the desired effect is unlikely to be achieved. If the V content is more than 0.50%, precipitates coarsen, and the strength improvement is saturated. Besides, proeutectoid ferrite precipitates during continuous casting, which facilitates cracking. The V content is therefore limited to a range of 0.02% to 0.50%. The V content is preferably in a range of 0.03% to 0.30%, and more preferably in a range of 0.03% to 0.25%.

Nb: 0.003% or more and 0.150% or less

Nb is very effective in improving fatigue resistance because, as a result of a temperature increase in nitrocarburizing, Nb forms fine precipitates with V and increases core hardness. If the Nb content is less than 0.003%, the desired effect is unlikely to be achieved. If the Nb content is more than 0.150%, precipitates coarsen, and the strength improvement is saturated. Besides, proeutectoid ferrite precipitates during continuous casting, which facilitates cracking. The Nb content is therefore limited to a range of 0.003% to 0.150%. The Nb content is preferably in a range of 0.020% to 0.120%.

Al: 0.005% or more and 0.200% or less

Al is an element useful in improving surface hardness and effective hardened case depth after nitrocarburizing treatment, and is accordingly added intentionally. Al is also useful in improving toughness by inhibiting the growth of austenite grains during hot forging to yield a finer microstructure. In view of this, the Al content is limited to 0.005% or more. If the Al content is more than 0.200%, the effects are saturated, and rather the component cost increases. The Al content is therefore limited to 0.200% or less. The Al content is preferably 0.020% or more and 0.100% or less, and more preferably 0.020% or more and 0.040% or less.

N: 0.0200% or less

N is a useful element that forms carbonitrides in the steel and improves the strength of the nitrocarburized material. Accordingly, the N content is preferably 0.0020% or more. If the N content is more than 0.0200%, coarser carbonitrides form, causing a decrease in the toughness of the steel material. Moreover, surface cracking occurs in the cast steel, and cast steel quality decreases. The N content is therefore limited to 0.0200% or less.

Sb: 0.0005% or more and 0.0200%

Sb has an effect of facilitating bainite phase formation. If the Sb content is less than 0.0005%, the effect is insufficient. If the Sb content is more than 0.0200%, the effect is saturated, and not only the component cost increases but also the toughness of base metal decreases due to segregation. The Sb content is therefore limited to a range of 0.0005% to 0.0200%. The Sb content is preferably in a range of 0.0010% to 0.0100%.

W: 0.3% or less (inclusive of 0%), Co: 0.3% or less (inclusive of 0%), Hf: 0.2% or less (inclusive of 0%), Zr: 0.2% or less (inclusive of 0%), Ti: 0.1% or less (inclusive of 0%)

W, Co, Hf, Zr, and Ti are each an element effective in improving the strength of the steel. These elements may be added, or omitted (the content may be 0%). To improve the strength of the steel, the W content is preferably 0.01% or more, the Co content is preferably 0.01% or more, the Hf content is preferably 0.01% or more, the Zr content is preferably 0.01% or more, and the Ti content is preferably 0.001% or more. These elements may be added in any combination. If the W content is more than 0.3%, if the Co content is more than 0.3%, if the Hf content is more than 0.2%, if the Zr content is more than 0.2%, or if the Ti content is more than 0.1%, the toughness of the steel decreases. Accordingly, the contents of these elements are limited to the foregoing ranges. Preferable ranges are W: 0.01% to 0.25%, Co: 0.01% to 0.25%, Hf: 0.01% to 0.15%, Zr: 0.01% to 0.15%, and Ti: 0.001% to 0.01%.

Of the elements described above, if the contents of carbonitride forming elements such as Cr, V, Nb, W, Co, Hf, Zr, and Ti are increased, N and C precipitate excessively in a part of the surface layer very close to the surface, as a result of which the hardened case depth decreases. To avoid this, it is important to satisfy the following Formula (1):

$$9.5 \leq ([Cr]/52+[V]/50.9+[Nb]/92.9+M)\times 10^3 \leq 18.5 \quad (1)$$

where M is a sum total of [W]/183.8, [Co]/58.9, [Hf]/178.5, [Zr]/91.2, and [Ti]/47.9, and the parentheses [ ] represent the content of the corresponding element in the parentheses (mass %).

An experiment that led to finding Formula (1) will be described below.

Steel ingots of 100 kg each having a chemical composition containing C: 0.05%, Si: 0.1%, Mn: 1.5%, Cr: (0 to 1.5) %, V: (0 to 0.3) %, Nb: (0 to 0.3) %, Mo: 0.1%, and N: 0.0100% with the balance being Fe and inevitable impurities were obtained by steelmaking. Each of the steel ingots was hot forged to obtain a steel bar of 33 mmφ. The obtained steel bar was held at 1200° C. for 1 hr, and then allowed to naturally cool, to obtain a hot-forged-equivalent material. A roller pitching test piece of 26 mmφ×130 mm illustrated in FIG. 1 was collected from the hot-forged-equivalent material. The test piece was subjected to nitrocarburizing treatment at 570° C. for 3 hr, and then a roller pitching test was performed. The roller pitching test was performed under the same conditions as the fatigue resistance evaluation described in the EXAMPLES section below.

Figure 2:
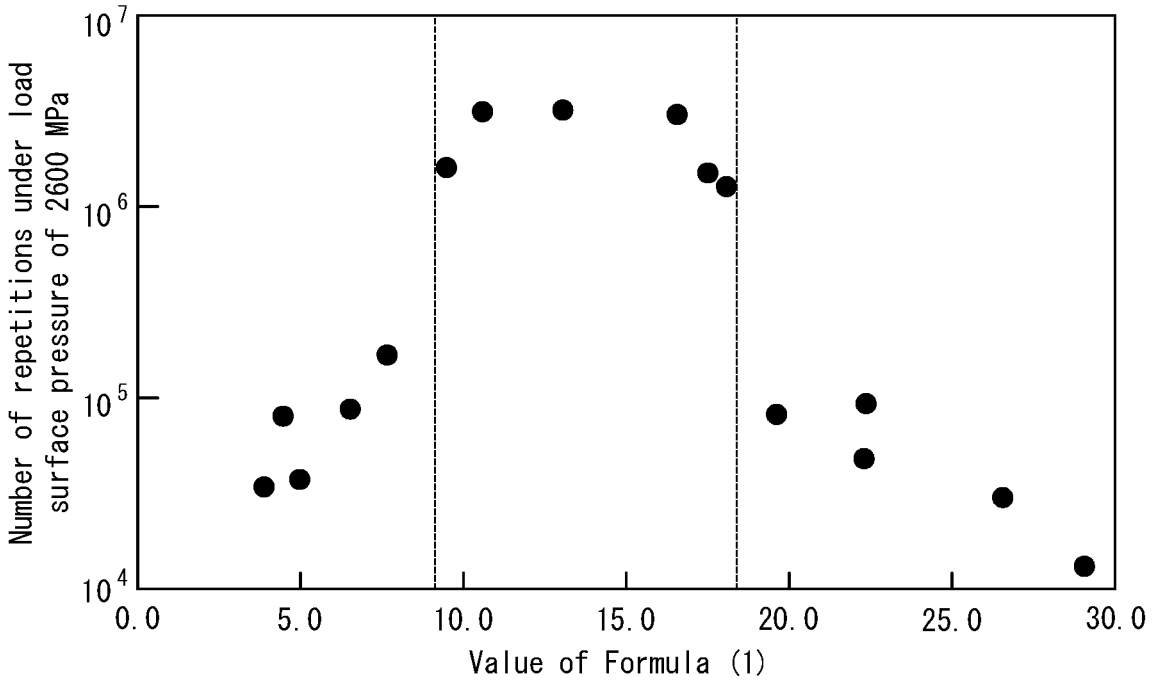
FIG. 2 is a graph illustrating the influence of the value of $([Cr]/52+[V]/50.9+[Nb]/92.9+M)\times 10^3$ on the surface fatigue strength.

FIG. 2 illustrates the results of the roller pitching test. As illustrated in FIG. 2, the surface fatigue resistance was particularly excellent in the case where the value of $([Cr]/52+[V]/50.9+[Nb]/92.9+M)\times 10^3$ was 9.5 or more and 18.5 or less. For a roller pitching test piece produced in the same way as above, the hardened case depth after nitrocarburizing treatment was measured under the same conditions as the fatigue resistance evaluation described in the EXAMPLES section below. As a result, the hardened case depth was shallower in the case where the value of $([Cr]/52+[V]/50.9+[Nb]/92.9+M)\times 10^3$ was more than 18.5 than in the case where the value was 18.5 or less. This is considered to be the reason why the surface fatigue resistance was lower in the case where the value was more than 18.5. Moreover, the surface hardness was lower in the case where the value was less than 9.5 than in the case where the value was 9.5 or more. This is considered to be the reason why the surface fatigue resistance was lower in the case where the value was less than 9.5.

To increase the hardened case depth, the contents of carbonitride forming elements such as Cr, V, Nb, W, Co, Hf, Zr, and Ti need to be reduced. To increase the hardened case depth after nitrocarburizing treatment, the contents (mass %) of these carbonitride forming elements need to satisfy the foregoing Formula (1).

The basic chemical composition according to the present disclosure has been described above. In addition, one or more of the following elements may be optionally added.

B: 0.0100% or less

B has an effect of improving quench hardenability and facilitating the formation of bainite microstructure. Hence, the B content is preferably 0.0003% or more. If the B content is more than 0.0100%, B precipitates as BN, and not only the quench hardenability improving effect is saturated but also the component cost increases. Accordingly, in the case of adding B, the B content is limited to 0.0100% or less. The B content is more preferably 0.0005% or more and 0.0080% or less.

Cu: 0.3% or less

Cu is a useful element that forms intermetallic compounds with Fe and Ni during nitrocarburizing treatment and improves the strength of the nitrocarburized material by precipitation hardening. Cu is also effective in bainite phase formation. If the Cu content is more than 0.3%, hot workability decreases. The Cu content is therefore limited to 0.3% or less. The Cu content is preferably in a range of 0.05% to 0.25%.

Ni: 0.3% or less

Ni has an effect of increasing quench hardenability and reducing low-temperature brittleness. If the Ni content is more than 0.3%, hardness increases, and as a result machinability by cutting decreases. This is also disadvantageous in terms of cost. The Ni content is therefore limited to 0.3% or less. The Ni content is preferably in a range of 0.05% to 0.25%.

Pb: 0.2% or less, Bi: 0.2% or less, Zn: 0.2% or less, Sn: 0.2% or less

Pb, Bi, Zn, and Sn are each an element that has an effect of improving the machinability by cutting of the steel. In the case of adding any of these elements, the content of the element is preferably 0.02% or more. If the content is more than 0.2%, strength and toughness decrease. Accordingly, the content is limited to this range. Preferable ranges are Pb: 0.02% to 0.1%, Bi: 0.02% to 0.1%, Zn: 0.02% to 0.1%, and Sn: 0.02% to 0.1%.

The balance of the steel composition other than the above-described elements is Fe and inevitable impurities. The balance preferably consists of Fe and inevitable impurities.

The reasons for limiting the steel microstructure of the steel for nitrocarburizing according to the present disclosure to the foregoing range will be described below.

Bainite phase: 50% in area ratio with respect to entire microstructure

The present disclosure is intended to cause V and Nb precipitates to be dispersion-precipitated in the core other than the surface layer nitrided portion after nitrocarburizing treatment, to increase core hardness and improve fatigue resistance after the nitrocarburizing treatment. Here, the presence of Cr, V, and Nb precipitates before the nitrocarburizing treatment is normally disadvantageous in terms of machinability by cutting during cutting work performed before the nitrocarburizing treatment. In bainite transformation, Cr, V, and Nb precipitates are unlikely to form in the matrix phase, as compared with ferrite-pearlite transformation. Hence, the steel microstructure of the steel for nitrocarburizing according to the present disclosure, i.e. the steel microstructure before the nitrocarburizing treatment, is mainly composed of bainite phase. Specifically, the area ratio of bainite phase with respect to the entire microstructure is more than 50%. The area ratio of bainite phase with respect to the entire microstructure is preferably more than 60%, and more preferably more than 80%. The area ratio of bainite phase with respect to the entire microstructure may be 100%. Microstructures other than bainite phase are, for example, ferrite phase and pearlite phase. The area ratios of these other microstructures are preferably as low as possible.

The area ratio of each phase can be calculated as follows. A test piece is collected from the obtained steel for nitrocarburizing. A section (L section) in parallel with the rolling direction of the test piece is surface polished, and then etched by natal. The types of phases are identified using an optical microscope through cross-sectional microstructure observation (optical microscope microstructure observation at 200 magnifications), and the area ratio of each phase is calculated.

It is also preferable that the amount of solute Cr, the amount of solute V, and the amount of solute Nb in the steel are respectively 0.27% or more, 0.05% or more, and 0.02% or more, and the proportion of the amount of solute Cr to the original content is 90% or more, the proportion of the amount of solute V to the original content is 75% or more, and the proportion of the amount of solute Nb to the original content is 50% or more. As mentioned above, the present disclosure is intended to cause Cr, V, and Nb to precipitate finely in nitrocarburizing treatment to thus improve fatigue resistance after the nitrocarburizing treatment. In terms of ensuring machinability by cutting, too, it is desirable to suppress the formation of Cr, V, and Nb precipitates. Accordingly, the amount of solute Cr, the amount of solute V, and the amount of solute Nb are preferably limited to these ranges.

When the above-described steel for nitrocarburizing is subjected to typical nitrocarburizing treatment, a component having greater hardened case depth than a component produced from conventional steel for nitrocarburizing can be obtained. Specifically, as a result of subjecting the above-described steel for nitrocarburizing to nitrocarburizing treatment at 560° C. for 3.5 hr in an atmosphere of $NH_3$:$N_2$:$CO_2$=50:45:5, an effective hardened case depth (described later) of 0.2 mm or more can be achieved.

A production method of producing a nitrocarburized component from steel for nitrocarburizing will be described below.

Figure 3:
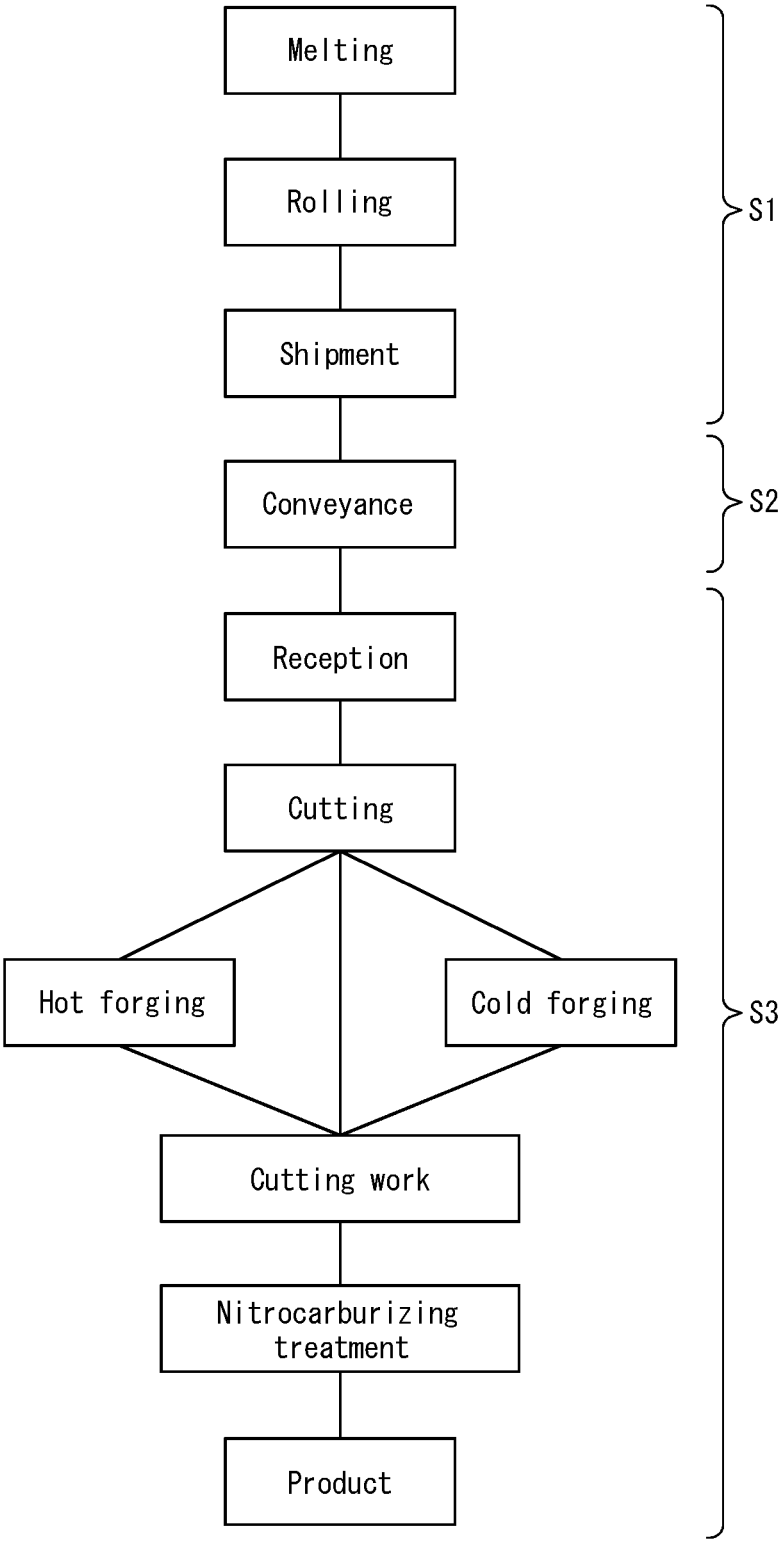
FIG. 3 is a diagram illustrating a typical production process of a nitrocarburized component.

FIG. 3 illustrates a typical process of producing a nitrocarburized component using the steel for nitrocarburizing (steel bar) according to the present disclosure. The method includes production of a steel bar (steel for nitrocarburizing) as raw material (S1), conveyance (S2), and component (nitrocarburized component) production (S3).

First, in the steel bar production (S1), a steel ingot is hot rolled and/or hot forged to obtain a steel bar, and the steel bar is shipped after quality inspection. In the nitrocarburized component finishing (S3) after the conveyance (S2), the steel bar is cut to predetermined dimensions, hot forged or cold forged, and optionally subjected to cutting work such as drill boring or lathe turning to form a desired shape (e.g. the shape of a gear component or a shaft component). After this, nitrocarburizing treatment is performed to obtain a product.

A hot-rolled material may be directly finished into a desired shape by cutting work such as lathe turning or drill boring, and then subjected to nitrocarburizing treatment to obtain a product. In the case of performing hot forging, the hot forging may be followed by cold straightening. The final product may be subjected to coating treatment such as painting or plating.

In the method of producing the steel for nitrocarburizing according to the present disclosure, hot working before nitrocarburizing treatment is performed under specific conditions of heating temperature and working temperature, to yield the above-described microstructure mainly composed of bainite phase and ensure the amounts of solute Cr, V, and Nb. The hot working mainly denotes hot rolling or hot forging, but hot rolling may be followed by hot forging. Alternatively, hot rolling may be followed by cold forging. In the case where the hot working immediately before the nitrocarburizing treatment is hot rolling, that is, in the case where hot rolling is not followed by hot forging, the following conditions are satisfied in the hot rolling.

Hot rolling heating temperature: 950° C. to 1250° C.

In the hot rolling, carbides remaining from the time of melting are dissolved in order to prevent fine precipitates from forming in the rolled material (the steel bar as the raw material of the component by cold forging and/or cutting work) and impairing forgeability.

If the rolling heating temperature is less than 950° C., carbides remaining from the time of melting are unlikely to dissolve. If the rolling heating temperature is more than 1250° C., crystal grains coarsen, and forgeability tends to decrease. The rolling heating temperature is therefore limited to 950° C. to 1250° C.

Rolling finish temperature: 800° C. or more

If the rolling finish temperature is less than 800° C., ferrite phase forms. This is disadvantageous in terms of forming bainite phase in an area ratio of more than 50% with respect to the entire microstructure of the steel for nitrocarburizing. Besides, the rolling load increases. The rolling finish temperature is therefore limited to 800° C. or more. The upper limit is preferably about 1100° C.

Cooling rate at least in temperature range of 700° C. to 550° C. after rolling: more than 0.4° C./s To prevent fine precipitates from forming before the finishing into the desired shape and impairing workability, that is, to ensure the above-described amounts of solute Cr, Nb, and V, the cooling rate after the rolling is limited to more than 0.4° C./s which is the critical cooling rate at which the above-described solute amounts can be ensured, at least in a temperature range of 700° C. to 550° C. which is the precipitation temperature range of fine precipitates. The upper limit is preferably about 200° C./s.

In the case where the hot working before the nitrocarburizing treatment is hot forging, that is, in the case where only hot forging is performed or hot rolling is followed by hot forging, the following conditions are satisfied in the hot forging. In the case where hot rolling is performed before the hot forging, the hot rolling conditions described above need not necessarily be satisfied.

Hot Forging Conditions

In the hot forging, the heating temperature in the hot forging is limited to 950° C. to 1250° C., the forging finish temperature is limited to 800° C. or more, and the cooling rate after the forging at least in a temperature range of 700° C. to 550° C. is limited to more than 0.4° C./s, in order to obtain bainite phase in an area ratio of more than 50% with respect to the entire microstructure and to prevent fine precipitates from forming and making it impossible to ensure solute Cr, V, and Nb in terms of cold straightening after the hot forging and machinability by cutting. The upper limit of the cooling rate is preferably about 200° C./s.

The resultant rolled material or forged material is then subjected to cutting work to form a component shape, and then subjected to nitrocarburizing treatment. The nitrocarburizing treatment may be performed under typical conditions. Specifically, the typical conditions are a treatment temperature of 550° C. to 700° C. and a treatment time of 10 min or more. As a result of the nitrocarburizing treatment with such treatment temperature and treatment time, Cr, V, and Nb in the solid solution state precipitate finely, and consequently the strength of the core increases. The hardened case obtained by the typical nitrocarburizing treatment conditions has greater hardened case thickness than that obtained from conventionally known steel for nitrocarburizing. If the treatment temperature is less than 550° C., a sufficient amount of precipitates cannot be obtained. If the treatment temperature is more than 700° C., the temperature is in the austenite region, and surface hardening treatment without phase transformation is difficult. Transformation expansion occurs, and distortion associated with surface hardening treatment increases. Such treatment can no longer be regarded as nitrocarburizing treatment, and the advantages of the nitrocarburizing treatment cannot be ensured. The nitrocarburizing treatment temperature is preferably in a range of 550° C. to 630° C.

The nitrocarburizing treatment infiltrates and diffuses N and C simultaneously into the steel. Accordingly, the nitrocarburizing treatment may be performed in a mixed atmosphere of a nitrogenous gas such as $NH_3$ or $N_2$ and a carburizing gas such as $CO_2$ or CO, e.g. an atmosphere of $NH_3$:$N_2$:$CO_2$=50:45:5.

The component according to the present disclosure is obtained as a result of this production process. The obtained component includes a core having the same chemical composition and steel microstructure as the steel for nitrocarburizing and a surface layer having a chemical composition in which the contents of nitrogen and carbon are higher than in the chemical composition of the core. In the component according to the present disclosure, precipitates containing Cr, V, and Nb are dispersion-precipitated in the bainite phase.

Chemical Composition of Core and Chemical Composition of Surface Layer

When the steel for nitrocarburizing having the above-described chemical composition is subjected to the nitrocarburizing treatment, nitrogen and carbon from the surface infiltrate and diffuse into the surface layer. On the other hand, the diffusion of nitrogen and carbon does not reach the core. That is, the part in which C and N are not diffused is the core. Hence, in the resultant component, the core has the same chemical composition as the steel for nitrocarburizing, whereas the surface layer has a chemical composition in which the contents of nitrogen and carbon are higher than in the core. If nitrogen and carbon are not infiltrated and diffused in the surface layer of the component, that is, if the contents of nitrogen and carbon are not higher in the surface layer than in the core, a hard layer is not formed in the surface layer, and sufficient improvement in fatigue strength cannot be expected.

Steel Microstructure of Core

In the component produced by subjecting the steel for nitrocarburizing according to the present disclosure to the nitrocarburizing treatment, the steel microstructure of the steel for nitrocarburizing remains in the core. In detail, the steel microstructure of the core in the component after the nitrocarburizing treatment includes bainite in an area ratio of more than 50% with respect to the entire microstructure. The steel microstructure of the core in the component is the same as the steel microstructure of the steel for nitrocarburizing. Accordingly, the area ratio of bainite phase with respect to the entire microstructure is preferably more than 60% and more preferably more than 80%, as mentioned above. The area ratio of bainite phase with respect to the entire microstructure may be 100%. Microstructures other than bainite phase are, for example, ferrite phase and pearlite phase. The area ratios of these other microstructures are preferably as low as possible.

Dispersion Precipitation of Cr-Containing Precipitates, V-Containing Precipitates, and Nb-Containing Precipitates in Bainite Phase When Cr-containing precipitates, V-containing precipitates, and Nb-containing precipitates are dispersion-precipitated in the bainite phase of the core, the core hardness increases, and the fatigue resistance of the component after the nitrocarburizing treatment increases significantly. Herein, the dispersion precipitation of Cr-containing precipitates, V-containing precipitates, and Nb-containing precipitates means their total dispersion precipitation state in which 500 or more particles of precipitates with a particle size of (preferably) less than 10 nm are dispersion-precipitated per unit area of 1 $\mu m^2$. Such dispersion precipitation is preferable in terms of strengthening by precipitation for the component after the nitrocarburizing treatment. The measurement limit of the precipitate particle size, i.e. the minimum measurable particle size, is 1 nm.

The component with the above-described structure has deep effective hardened case depth (described later) and high surface hardness and core hardness. Specifically, the component has an effective hardened case depth of 0.2 mm or more, a surface hardness of 700 HV or more, and a core hardness of 200 HV or more.

Effective Hardened Case Depth: 0.2 mm or More

The effective hardened case depth herein is the depth of the effective hardened case that is a region having hardness greater than or equal to a specific value. Specifically, the depth (mm) from the surface with HV 550 is taken to be the effective hardened case depth. It is difficult to achieve high fatigue strength unless the effective hardened case depth is 0.2 mm or more. The effective hardened case depth is therefore preferably 0.2 mm or more. The effective hardened case depth is more preferably 0.25 mm or more.

The component according to the present disclosure preferably has a surface hardness of 700 HV or more and a core hardness of 200 HV or more. The component satisfying these hardness conditions has favorable fatigue resistance.

EXAMPLES

Examples will be described below.

Steels (steel samples No. 1 to 42) having the compositions shown in Table 1 were each formed into cast steel of 300 mm×400 mm in cross section by a continuous casting machine. Whether the cast steel had cracks at the surface was examined. The cast steel was soaked at 1250° C. for 30 min, and then hot rolled to obtain a billet with a rectangular section of 140 mm on a side. The billet was hot rolled to obtain a steel bar (raw material as hot rolled) of 60 mmφ. The heating temperature of the billet in the hot rolling, the rolling finish temperature, and the cooling rate in a range of 700° C. to 550° C. after the hot rolling are shown in Table 2.

Some of the raw materials as hot rolled were each hot forged at the heating temperature and the forging finish temperature shown in Table 2, to obtain a steel bar of 30 mmφ. After this, the steel bar was cooled to room temperature at the cooling rate in a range of 700° C. to 550° C. shown in Table 2, to obtain a hot forged material.

TABLE 1

(mass %)

| Steel sample No. | C | Si | Mn | P | S | Cr | Mo | V | Nb | Al | N | Sb | Others | Formula 1*) | Category |
|---|---|---|---|---|---|---|---|---|---|---|---|---|---|---|---|
| 1 | 0.043 | 0.05 | 1.75 | 0.014 | 0.015 | 0.61 | 0.070 | 0.08 | 0.063 | 0.035 | 0.0090 | 0.0005 | — | 14.0 | Example |
| 2 | 0.056 | 0.11 | 1.45 | 0.012 | 0.019 | 0.32 | 0.006 | 0.14 | 0.074 | 0.031 | 0.0044 | 0.0006 | — | 9.7 | Example |
| 3 | 0.061 | 0.25 | 2.42 | 0.012 | 0.017 | 0.55 | 0.105 | 0.12 | 0.051 | 0.028 | 0.0053 | 0.0007 | — | 13.5 | Example |
| 4 | 0.021 | 0.35 | 1.65 | 0.015 | 0.015 | 0.45 | 0.123 | 0.09 | 0.149 | 0.123 | 0.0048 | 0.0007 | — | 12.0 | Example |
| 5 | 0.033 | 0.65 | 1.75 | 0.010 | 0.016 | 0.36 | 0.051 | 0.12 | 0.132 | 0.013 | 0.0055 | 0.0012 | — | 10.7 | Example |
| 6 | 0.016 | 0.06 | 1.76 | 0.012 | 0.015 | 0.56 | 0.190 | 0.20 | 0.083 | 0.006 | 0.0053 | 0.0018 | — | 15.6 | Example |
| 7 | 0.061 | 0.07 | 1.55 | 0.008 | 0.016 | 0.56 | 0.185 | 0.18 | 0.034 | 0.007 | 0.0045 | 0.0009 | — | 14.7 | Example |
| 8 | 0.091 | 0.06 | 1.76 | 0.012 | 0.015 | 0.61 | 0.124 | 0.20 | 0.084 | 0.097 | 0.0123 | 0.0052 | — | 16.6 | Example |
| 9 | 0.098 | 0.07 | 1.64 | 0.008 | 0.016 | 0.34 | 0.090 | 0.34 | 0.123 | 0.064 | 0.0045 | 0.0185 | — | 14.5 | Example |
| 10 | 0.033 | 0.86 | 1.82 | 0.010 | 0.023 | 0.46 | 0.183 | 0.21 | 0.111 | 0.025 | 0.0056 | 0.0056 | — | 14.2 | Example |
| 11 | 0.064 | 0.05 | 1.77 | 0.012 | 0.017 | 0.52 | 0.084 | 0.04 | 0.124 | 0.023 | 0.0046 | 0.0098 | — | 12.1 | Example |
| 12 | 0.037 | 0.06 | 1.69 | 0.008 | 0.015 | 0.55 | 0.126 | 0.18 | 0.004 | 0.013 | 0.0036 | 0.0008 | B: 0.0005 | 14.2 | Example |
| 13 | 0.033 | 0.12 | 2.26 | 0.015 | 0.016 | 0.61 | 0.193 | 0.13 | 0.148 | 0.037 | 0.0192 | 0.0010 | Cu: 0.1 | 15.9 | Example |
| 14 | 0.068 | 0.31 | 1.69 | 0.018 | 0.033 | 0.32 | 0.180 | 0.15 | 0.039 | 0.031 | 0.0054 | 0.0006 | Cu: 0.1, Ni: 0.15 | 9.5 | Example |
| 15 | 0.043 | 0.02 | 1.85 | 0.012 | 0.018 | 0.65 | 0.050 | 0.10 | 0.049 | 0.025 | 0.0060 | 0.0040 | W: 0.2 | 16.6 | Example |
| 16 | 0.095 | 0.05 | 1.51 | 0.010 | 0.020 | 0.55 | 0.103 | 0.15 | 0.148 | 0.031 | 0.0120 | 0.0060 | Co: 0.3 | 15.1 | Example |
| 17 | 0.092 | 0.20 | 1.98 | 0.015 | 0.017 | 0.54 | 0.123 | 0.18 | 0.050 | 0.028 | 0.0130 | 0.0008 | Hf: 0.2, Zr: 0.2 | 17.8 | Example |
| 18 | 0.088 | 0.03 | 1.86 | 0.013 | 0.015 | 0.49 | 0.089 | 0.12 | 0.147 | 0.130 | 0.0097 | 0.0070 | Pb: 0.1 | 13.4 | Example |
| 19 | 0.094 | 0.75 | 1.75 | 0.010 | 0.016 | 0.33 | 0.051 | 0.15 | 0.133 | 0.137 | 0.0090 | 0.0012 | Bi: 0.2 | 10.7 | Example |
| 20 | 0.045 | 0.02 | 1.54 | 0.012 | 0.013 | 0.33 | 0.062 | 0.45 | 0.110 | 0.045 | 0.0150 | 0.0040 | Zn: 0.2 | 16.4 | Example |
| 21 | 0.011 | 0.05 | 2.98 | 0.009 | 0.045 | 0.65 | 0.080 | 0.17 | 0.034 | 0.034 | 0.0157 | 0.0009 | Sn: 0.2 | 16.2 | Example |
| 22 | 0.005 | 0.04 | 2.12 | 0.013 | 0.014 | 0.49 | 0.070 | 0.21 | 0.040 | 0.026 | 0.0132 | 0.0012 | — | 14.0 | Comparative Example |
| 23 | 0.153 | 0.09 | 1.65 | 0.014 | 0.024 | 0.66 | 0.142 | 0.14 | 0.069 | 0.045 | 0.0065 | 0.0012 | — | 16.2 | Comparative Example |
| 24 | 0.084 | 1.26 | 1.65 | 0.012 | 0.024 | 0.55 | 0.111 | 0.16 | 0.078 | 0.035 | 0.0073 | 0.0053 | — | 14.6 | Comparative Example |
| 25 | 0.053 | 0.25 | 0.48 | 0.013 | 0.019 | 0.45 | 0.074 | 0.15 | 0.101 | 0.037 | 0.0047 | 0.0008 | — | 12.7 | Comparative Example |
| 26 | 0.061 | 0.09 | 3.24 | 0.018 | 0.025 | 0.36 | 0.068 | 0.21 | 0.049 | 0.135 | 0.0052 | 0.0009 | — | 11.6 | Comparative Example |
| 27 | 0.036 | 0.13 | 1.61 | 0.028 | 0.018 | 0.35 | 0.079 | 0.13 | 0.064 | 0.088 | 0.0063 | 0.0012 | — | 10.0 | Comparative Example |
| 28 | 0.051 | 0.13 | 2.13 | 0.018 | 0.075 | 0.54 | 0.195 | 0.25 | 0.063 | 0.153 | 0.0124 | 0.0013 | — | 16.0 | Comparative Example |
| 29 | 0.095 | 0.13 | 1.61 | 0.018 | 0.022 | 0.25 | 0.094 | 0.10 | 0.057 | 0.132 | 0.0032 | 0.0006 | — | 7.4 | Comparative Example |
| 30 | 0.090 | 0.13 | 1.61 | 0.018 | 0.022 | 1.37 | 0.118 | 0.11 | 0.054 | 0.157 | 0.0032 | 0.0012 | — | 29.1 | Comparative Example |
| 31 | 0.065 | 0.05 | 1.64 | 0.016 | 0.015 | 0.70 | 0.004 | 0.12 | 0.075 | 0.053 | 0.0056 | 0.0010 | — | 16.6 | Comparative Example |
| 32 | 0.036 | 0.22 | 1.73 | 0.014 | 0.034 | 0.56 | 0.096 | 0.01 | 0.052 | 0.024 | 0.0152 | 0.0009 | — | 11.5 | Comparative Example |
| 33 | 0.034 | 0.31 | 1.48 | 0.011 | 0.008 | 0.55 | 0.132 | 0.55 | 0.069 | 0.024 | 0.0065 | 0.0007 | — | 22.1 | Comparative Example |
| 34 | 0.045 | 0.06 | 1.66 | 0.015 | 0.026 | 0.34 | 0.062 | 0.14 | 0.002 | 0.097 | 0.0088 | 0.0014 | — | 9.3 | Comparative Example |
| 35 | 0.035 | 0.06 | 1.66 | 0.008 | 0.015 | 0.46 | 0.059 | 0.06 | 0.156 | 0.065 | 0.0051 | 0.0011 | — | 11.7 | Comparative Example |
| 36 | 0.085 | 0.06 | 1.66 | 0.012 | 0.026 | 0.60 | 0.057 | 0.13 | 0.054 | 0.004 | 0.0088 | 0.0009 | — | 14.7 | Comparative Example |
| 37 | 0.088 | 0.06 | 1.66 | 0.015 | 0.026 | 0.54 | 0.063 | 0.09 | 0.046 | 0.211 | 0.0103 | 0.0015 | — | 12.6 | Comparative Example |
| 38 | 0.086 | 0.05 | 1.65 | 0.015 | 0.014 | 0.59 | 0.070 | 0.20 | 0.075 | 0.022 | 0.0251 | 0.0010 | — | 16.1 | Comparative Example |
| 39 | 0.035 | 0.13 | 1.92 | 0.016 | 0.028 | 0.87 | 0.164 | 0.11 | 0.045 | 0.030 | 0.0059 | 0.0008 | — | 19.4 | Comparative Example |
| 40 | 0.083 | 0.02 | 0.95 | 0.011 | 0.025 | 0.35 | 0.149 | 0.12 | 0.012 | 0.018 | 0.0052 | 0.0010 | — | 9.2 | Comparative Example |
| 41 | 0.050 | 0.03 | 1.46 | 0.010 | 0.016 | 0.56 | 0.101 | 0.15 | 0.146 | 0.037 | 0.0123 | 0.0002 | — | 15.3 | Comparative Example |
| 42 | 0.206 | 0.33 | 0.81 | 0.014 | 0.021 | 1.15 | 0.001 | 0.01 | 0.001 | 0.027 | 0.0130 | — | — | — | Conventional Example |

*1Underlines indicate outside application range.

*)Formula 1: $([Cr]/52 + [V]/50.9 + [Nb]/92.9 + [M]) \times 10^3$

TABLE 2

| | | | Hot rolling conditions | | | Hot forging conditions | | | |
|---|---|---|---|---|---|---|---|---|---|
| No. | Steel sample No. | Billet surface cracking*4 | Heating temperature in hot rolling (° C.) | Hot rolling finish temperature (° C.) | Cooling rate after hot rolling (° C.) | Heating temperature in hot forging (° C.) | Hot forging finish temperature (° C.) | Cooling rate after hot forging (° C./s) | Remarks |
| 1 | 1 | A | 1150 | 970 | 0.8 | 1200 | 1100 | 0.8 | Example |
| 2 | 2 | A | 1150 | 970 | 0.7 | 1200 | 1100 | 0.8 | Example |
| 3 | 3 | A | 1150 | 970 | 0.8 | 1200 | 1100 | 0.8 | Example |
| 4 | 4 | A | 1150 | 970 | 0.7 | 1200 | 1100 | 0.8 | Example |
| 5 | 5 | A | 1150 | 970 | 0.8 | 1200 | 1100 | 0.7 | Example |
| 6 | 6 | B | 1150 | 970 | 0.8 | 1200 | 1100 | 0.8 | Example |
| 7 | 7 | B | 1150 | 970 | 0.6 | 1200 | 1100 | 0.8 | Example |
| 8 | 8 | A | 1150 | 970 | 0.8 | 1200 | 1100 | 0.8 | Example |
| 9 | 9 | A | 1150 | 970 | 0.8 | 1200 | 1100 | 0.5 | Example |
| 10 | 10 | A | 1150 | 970 | 0.5 | 1200 | 1100 | 0.8 | Example |
| 11 | 11 | A | 1050 | 900 | 0.8 | 1200 | 1100 | 0.6 | Example |
| 12 | 12 | A | 1150 | 970 | 0.8 | 1200 | 1100 | 0.8 | Example |
| 13 | 13 | B | 1050 | 910 | 0.8 | 1200 | 1100 | 0.5 | Example |
| 14 | 14 | A | 1080 | 920 | 0.8 | 1200 | 1100 | 0.8 | Example |
| 15 | 15 | A | 1150 | 970 | 0.8 | 1200 | 1100 | 0.8 | Example |
| 16 | 16 | A | 1150 | 970 | 0.7 | 1200 | 1100 | 0.8 | Example |

TABLE 2-continued

| No. | Steel sample No. | Billet surface cracking*4 | Hot rolling conditions: Heating temperature in hot rolling (° C.) | Hot rolling conditions: Hot rolling finish temperature (° C.) | Hot rolling conditions: Cooling rate after hot rolling (° C.) | Hot forging conditions: Heating temperature in hot forging (° C.) | Hot forging conditions: Hot forging finish temperature (° C.) | Hot forging conditions: Cooling rate after hot forging (° C./s) | Remarks |
|---|---|---|---|---|---|---|---|---|---|
| 17 | 17 | A | 1150 | 970 | 0.5 | 1200 | 1100 | 0.5 | Example |
| 18 | 18 | B | 1150 | 970 | 0.8 | 1200 | 1100 | 0.8 | Example |
| 19 | 19 | B | 1150 | 970 | 0.8 | 1200 | 1100 | 0.8 | Example |
| 20 | 20 | B | 1150 | 970 | 0.8 | 1200 | 1100 | 0.6 | Example |
| 21 | 21 | B | 1150 | 970 | 0.8 | 1200 | 1100 | 0.8 | Example |
| 22 | 1 | A | 1150 | 970 | 0.8 | 960 | 840 | 0.8 | Example |
| 23 | 1 | A | 1150 | 970 | 0.8 | 1250 | 1050 | 0.8 | Example |
| 24 | 1 | A | 1150 | 970 | 0.8 | — | — | — | Example |
| 25 | 1 | A | 960 | 810 | 0.8 | — | — | — | Example |
| 26 | 1 | A | 1250 | 1050 | 0.8 | — | — | — | Example |
| 27 | 1 | A | 930 | 815 | 0.8 | — | — | — | Comparative Example |
| 28 | 1 | A | 1150 | 750 | 0.8 | — | — | — | Comparative Example |
| 29 | 1 | A | 1150 | 970 | 0.3 | — | — | — | Comparative Example |
| 30 | 1 | A | 1150 | 970 | 0.4 | — | — | — | Comparative Example |
| 31 | 1 | A | 1150 | 970 | 0.8 | 900 | 1100 | 0.8 | Comparative Example |
| 32 | 1 | A | 1150 | 970 | 0.8 | 1200 | 750 | 0.8 | Comparative Example |
| 33 | 1 | A | 1150 | 970 | 0.8 | 1200 | 1100 | 0.3 | Comparative Example |
| 34 | 1 | A | 1150 | 970 | 0.8 | 1200 | 1100 | 0.4 | Comparative Example |
| 35 | 22 | A | 1150 | 970 | 0.8 | 1200 | 1100 | 0.8 | Comparative Example |
| 36 | 23 | B | 1150 | 970 | 0.8 | 1200 | 1100 | 0.8 | Comparative Example |
| 37 | 24 | B | 1150 | 970 | 0.8 | 1200 | 1100 | 0.8 | Comparative Example |
| 38 | 25 | A | 1150 | 970 | 0.8 | 1200 | 1100 | 0.8 | Comparative Example |
| 39 | 26 | C | 1150 | 970 | 0.8 | 1200 | 1100 | 0.8 | Comparative Example |
| 40 | 27 | C | 1150 | 970 | 0.8 | 1200 | 1100 | 0.8 | Comparative Example |
| 41 | 28 | C | 1150 | 970 | 0.8 | 1200 | 1100 | 0.8 | Comparative Example |
| 42 | 29 | A | 1150 | 970 | 0.8 | 1200 | 1100 | 0.8 | Comparative Example |
| 43 | 30 | B | 1150 | 970 | 0.8 | 1200 | 1100 | 0.8 | Comparative Example |
| 44 | 31 | A | 1150 | 970 | 0.8 | 1200 | 1100 | 0.8 | Comparative Example |
| 45 | 32 | A | 1150 | 970 | 0.8 | 1200 | 1100 | 0.8 | Comparative Example |
| 46 | 33 | C | 1150 | 970 | 0.8 | 1200 | 1100 | 0.8 | Comparative Example |
| 47 | 34 | A | 1150 | 970 | 0.8 | 1200 | 1100 | 0.8 | Comparative Example |
| 48 | 35 | C | 1150 | 970 | 0.8 | 1200 | 1100 | 0.8 | Comparative Example |
| 49 | 36 | A | 1150 | 970 | 0.8 | 1200 | 1100 | 0.8 | Comparative Example |
| 50 | 37 | C | 1150 | 970 | 0.8 | 1200 | 1100 | 0.8 | Comparative Example |
| 51 | 38 | C | 1150 | 970 | 0.8 | 1200 | 1100 | 0.8 | Comparative Example |
| 52 | 39 | A | 1150 | 970 | 0.8 | 1200 | 1100 | 0.8 | Comparative Example |
| 53 | 40 | A | 1150 | 970 | 0.8 | 1200 | 1100 | 0.8 | Comparative Example |
| 54 | 41 | C | 1150 | 970 | 0.8 | 1200 | 1100 | 0.8 | Comparative Example |
| 55 | 42 | B | 1150 | 970 | 0.8 | 1200 | 1100 | 0.8 | Conventional Example |

*1Underlines indicate outside application range.

*4Cast steel surface cracking A: no cracks, B: 1 to 4 cracks/$m^2$, C: 5 or more cracks/$m^2$ The machinability by cutting (tool life) of each of the resultant raw materials as hot rolled and hot forged materials was evaluated by an outer periphery turning test. As the test material, the raw material as hot rolled or the hot forged material was cut to a length of 200 mm. As the cutting tool, CSBNR 2020 produced by Mitsubishi Materials Corporation was used as the folder and SNGN 120408 UTi20 high-speed tool steel produced by Mitsubishi Materials Corporation was used as the tip. The conditions of the outer periphery turning test were as follows: cutting depth: 1.0 mm, feed rate: 0.25 mm/rev, cutting rate: 200 m/min, and no lubricant. As an evaluation item, the tool life was defined as the time until the tool wear (flank wear) reached 0.2 mm.

In addition, microstructure observation and hardness measurement were performed on each of the raw materials as hot rolled and the hot forged materials. A test piece for evaluation was collected from a center portion of the raw material as hot rolled or the hot forged material. In the microstructure observation, the types of phases were identified and the area ratio of each phase was calculated by the above-described method. In the hardness measurement, hardness at one-fourth the diameter from the surface was measured at five locations with a test load of 2.94 N (300 gf) using a Vickers hardness meter in accordance with JIS Z 2244, and the average value was taken to be hardness HV. The measurement results and evaluation results are shown in Table 3.

TABLE 3

| No. | Steel properties (before nitrocarburizing treatment): Core hardness HV | Steel micro-structure | Bainite phase area ratio (%) | Amount of solute (mass %): Cr | V | Nb | Amount of solute/amount added (%): Cr | V | Nb | Tool life (s) | Remarks |
|---|---|---|---|---|---|---|---|---|---|---|---|
| 1 | 253 | Mainly B | 92 | 0.60 | 0.07 | 0.034 | 98 | 84 | 55 | 630 | Example |
| 2 | 301 | Mainly B | 98 | 0.30 | 0.12 | 0.044 | 93 | 83 | 59 | 510 | Example |

TABLE 3-continued

| | Steel properties (before nitrocarburizing treatment) | | | | | | | | | | |
|---|---|---|---|---|---|---|---|---|---|---|---|
| | Core hardness | Steel micro- | Bainite phase area ratio | Amount of solute (mass %) | | | Amount of solute/ amount added (%) | | | Tool life | |
| No. | HV | structure | (%) | Cr | V | Nb | Cr | V | Nb | (s) | Remarks |
| 3 | 317 | Mainly B | 97 | 0.53 | 0.10 | 0.027 | 97 | 81 | 53 | 471 | Example |
| 4 | 282 | Mainly B | 95 | 0.43 | 0.07 | 0.089 | 95 | 78 | 60 | 559 | Example |
| 5 | 280 | Mainly B | 96 | 0.33 | 0.09 | 0.067 | 90 | 75 | 51 | 563 | Example |
| 6 | 285 | Mainly B | 98 | 0.53 | 0.15 | 0.049 | 94 | 76 | 60 | 550 | Example |
| 7 | 279 | Mainly B | 94 | 0.52 | 0.14 | 0.020 | 93 | 75 | 59 | 564 | Example |
| 8 | 284 | Mainly B | 96 | 0.60 | 0.17 | 0.048 | 98 | 84 | 57 | 552 | Example |
| 9 | 252 | Mainly B | 55 | 0.32 | 0.29 | 0.067 | 95 | 84 | 55 | 632 | Example |
| 10 | 291 | Mainly B | 93 | 0.42 | 0.17 | 0.059 | 91 | 79 | 53 | 534 | Example |
| 11 | 281 | Mainly B | 60 | 0.48 | 0.03 | 0.064 | 92 | 83 | 51 | 561 | Example |
| 12 | 277 | Mainly B | 97 | 0.49 | 0.14 | 0.002 | 89 | 78 | 50 | 570 | Example |
| 13 | 290 | Mainly B | 96 | 0.56 | 0.11 | 0.081 | 91 | 83 | 55 | 538 | Example |
| 14 | 275 | Mainly B | 80 | 0.29 | 0.12 | 0.021 | 91 | 81 | 54 | 575 | Example |
| 15 | 296 | Mainly B | 95 | 0.58 | 0.08 | 0.026 | 90 | 78 | 52 | 625 | Example |
| 16 | 363 | Mainly B | 100 | 0.52 | 0.12 | 0.079 | 94 | 80 | 53 | 483 | Example |
| 17 | 335 | Mainly B | 92 | 0.49 | 0.14 | 0.028 | 90 | 78 | 56 | 543 | Example |
| 18 | 280 | Mainly B | 96 | 0.44 | 0.10 | 0.081 | 89 | 79 | 55 | 1205 | Example |
| 19 | 301 | Mainly B | 98 | 0.31 | 0.13 | 0.078 | 93 | 84 | 59 | 1360 | Example |
| 20 | 256 | Mainly B | 97 | 0.31 | 0.35 | 0.064 | 94 | 78 | 58 | 1230 | Example |
| 21 | 237 | Mainly B | 95 | 0.60 | 0.14 | 0.020 | 92 | 82 | 59 | 750 | Example |
| 22 | 249 | Mainly B | 88 | 0.56 | 0.07 | 0.037 | 92 | 84 | 59 | 640 | Example |
| 23 | 256 | Mainly B | 96 | 0.56 | 0.06 | 0.035 | 92 | 81 | 56 | 623 | Example |
| 24 | 252 | Mainly B | 96 | 0.60 | 0.07 | 0.036 | 98 | 82 | 57 | 632 | Example |
| 25 | 239 | Mainly B | 87 | 0.57 | 0.06 | 0.032 | 94 | 76 | 51 | 665 | Example |
| 26 | 233 | Mainly B | 75 | 0.60 | 0.06 | 0.035 | 98 | 80 | 55 | 680 | Example |
| 27 | 189 | F + P + B | 42 | 0.49 | 0.06 | 0.026 | 80 | 71 | 41 | 405 | Comparative Example |
| 28 | 222 | F + P + B | 24 | 0.46 | 0.05 | 0.025 | 75 | 64 | 40 | 309 | Comparative Example |
| 29 | 210 | F + P + B | 38 | 0.46 | 0.05 | 0.023 | 76 | 67 | 37 | 186 | Comparative Example |
| 30 | 215 | F + P + B | 45 | 0.46 | 0.06 | 0.030 | 75 | 73 | 48 | 213 | Comparative Example |
| 31 | 195 | F + P + B | 45 | 0.45 | 0.06 | 0.030 | 74 | 72 | 47 | 299 | Comparative Example |
| 32 | 256 | F + P + B | 24 | 0.42 | 0.05 | 0.025 | 69 | 67 | 40 | 126 | Comparative Example |
| 33 | 220 | F + P + B | 41 | 0.45 | 0.06 | 0.026 | 73 | 70 | 41 | 133 | Comparative Example |
| 34 | 231 | F + P + B | 48 | 0.48 | 0.06 | 0.025 | 78 | 74 | 40 | 136 | Comparative Example |
| 35 | 154 | F + B | 32 | 0.46 | 0.19 | 0.028 | 94 | 89 | 70 | 1250 | Comparative Example |
| 36 | 389 | Mainly B | 95 | 0.59 | 0.11 | 0.036 | 89 | 77 | 52 | 126 | Comparative Example |
| 37 | 356 | Mainly B | 85 | 0.51 | 0.13 | 0.046 | 92 | 83 | 58 | 374 | Comparative Example |
| 38 | 321 | F + P | 32 | 0.33 | 0.11 | 0.032 | 73 | 70 | 32 | 133 | Comparative Example |
| 39 | 363 | M + B | 96 | 0.33 | 0.17 | 0.028 | 92 | 83 | 58 | 224 | Comparative Example |
| 40 | 298 | Mainly B | 96 | 0.32 | 0.11 | 0.038 | 92 | 84 | 59 | 517 | Comparative Example |
| 41 | 281 | Mainly B | 95 | 0.49 | 0.20 | 0.035 | 90 | 80 | 55 | 561 | Comparative Example |
| 42 | 285 | F + P + B | 23 | 0.18 | 0.07 | 0.018 | 71 | 69 | 31 | 169 | Comparative Example |
| 43 | 401 | M + B | 56 | 1.29 | 0.09 | 0.029 | 94 | 79 | 54 | 122 | Comparative Example |
| 44 | 202 | F + P + B | 18 | 0.48 | 0.06 | 0.029 | 69 | 49 | 38 | 162 | Comparative Example |
| 45 | 191 | Mainly B | 96 | 0.55 | 0.01 | 0.028 | 98 | 78 | 53 | 510 | Comparative Example |
| 46 | 320 | Mainly B | 97 | 0.54 | 0.46 | 0.040 | 99 | 83 | 58 | 312 | Comparative Example |
| 47 | 223 | Mainly B | 95 | 0.31 | 0.11 | 0.001 | 90 | 80 | 55 | 505 | Comparative Example |
| 48 | 280 | Mainly B | 96 | 0.41 | 0.05 | 0.085 | 90 | 79 | 54 | 493 | Comparative Example |
| 49 | 307 | Mainly B | 94 | 0.57 | 0.11 | 0.031 | 95 | 82 | 57 | 495 | Comparative Example |
| 50 | 292 | Mainly B | 87 | 0.50 | 0.07 | 0.026 | 93 | 82 | 57 | 533 | Comparative Example |
| 51 | 290 | Mainly B | 90 | 0.53 | 0.17 | 0.045 | 90 | 83 | 60 | 434 | Comparative Example |
| 52 | 306 | Mainly B | 94 | 0.79 | 0.09 | 0.027 | 91 | 84 | 59 | 498 | Comparative Example |
| 53 | 285 | Mainly B | 93 | 0.34 | 0.09 | 0.006 | 98 | 77 | 52 | 551 | Comparative Example |
| 54 | 278 | Mainly B | 90 | 0.53 | 0.11 | 0.075 | 95 | 77 | 52 | 568 | Comparative Example |
| 55 | 220 | F + P | — | — | — | — | — | — | — | 265 | Conventional Example |

*1Underlines indicate outside application range.

*2Symbols for microstructure represent the following phases: F: ferrite, P: pearlite, B: bainite, M: martensite Furthermore, from each of the raw materials as hot rolled and the hot forged materials, a roller pitching test piece having a parallel portion of 26 mmφ×28 mm long and grip portions of 24.3 mmφ×51 mm on both sides as illustrated in FIG. 1 was collected in the longitudinal direction. The test piece was subjected to nitrocarburizing treatment under two types of conditions: at the treatment temperature shown in Table 4 for 3.5 hr; and at 560° C. for 3.5 hr. The nitrocarburizing treatment was performed in an atmosphere of $NH_3$:$N_2$:$CO_2$=50:45:5. For comparison, the hot forged material of steel sample No. 35 was subjected to carburizing-quenching-tempering of carburizing at 930° C. for 3 hr, holding at 850° C. for 40 min, then oil quenching, and further tempering at 170° C. for 1 hr.

For each of the nitrocarburized materials obtained as a result of the nitrocarburizing treatment at the nitrocarburizing treatment temperature shown in Table 4 and the carburized-quenched-tempered materials, microstructure observation, hardness measurement, precipitate observation, measurement of the amounts of solute Cr, solute V, and solute Nb, and fatigue resistance evaluation were performed.

In the microstructure observation, the types of phases were identified and the area ratio of each phase was calculated by the above-described method, as in the microstructure observation before the nitrocarburizing treatment.

In the hardness measurement, for each of the nitrocarburized materials obtained as a result of the nitrocarburizing treatment at the nitrocarburizing treatment temperature shown in Table 4 and the carburized-quenched-tempered materials, the hardness of the surface layer was measured at a depth of 0.05 mm from the surface of the parallel portion, and the hardness of the core of the parallel portion was measured at one-fourth the diameter from the surface. The surface layer hardness and the core hardness were both measured at six locations with a test load of 2.94 N (300 gf) using a Vickers hardness meter in accordance with JIS Z 2244, and the respective average values were taken to be surface layer hardness HV and core hardness HV. As the hardened case depth, the depth (effective hardened case depth) from the surface with HV 550 was measured. The hardened case depth was also measured for the test pieces subjected to nitrocarburizing treatment at 560° C. for 3.5 hr.

In the precipitate observation, from the position of one-fourth the diameter from the surface of the parallel portion of each of the nitrocarburized materials at the nitrocarburizing temperature shown in Table 4 and the carburized-quenched-tempered materials, a test piece for transmission electron microscope (TEM) observation was prepared by twin-jet electropolishing, and precipitates in the test piece were observed using a transmission electron microscope with an acceleration voltage of 200 V. Further, the compositions of the observed precipitates were determined with an energy-dispersive X-ray spectrometer (EDX).

In the measurement of the amounts of solute Cr, solute V, and solute Nb, a test piece of 10 mm×10 mm×40 mm was collected from a position of one-fourth the diameter from the surface of the above-described hot-forged steel bar of 30 mmφ, and constant-current electrolysis was applied using a 10% acetylacetone-1% tetramethylammonium-methanol electrolytic solution. The extracted precipitates were collected using a filter having a pore size of 0.2 mm. The precipitates were decomposed and formed into a solution using a mixed acid, and then analyzed by ICP optical emission spectrometry to measure the amount of precipitates. The amount of precipitates was then subtracted from the original content to obtain the solute amount.

In the fatigue resistance evaluation, roller pitching test pieces (see FIG. 1) after the nitrocarburizing treatment at the nitrocarburizing temperature shown in Table 4 or the carburizing-quenching-tempering and not subjected to any of the microstructure observation, the hardness measurement, and the precipitate observation were used in a roller pitching test, and the number of repetitions up to damage under a load surface pressure of 2600 MPa was counted. The parallel portion of 26 mmφ of the roller pitching test piece was a portion serving as a ralling contact surface, and was as nitrocarburized (without polishing) or as carburized-quenched-tempered (without polishing). As the roller pitching test conditions, the slip rate was 40%, automatic transmission oil (Mitsubishi ATF SP-III) was used as the lubricating oil, and the oil temperature was 80° C. As large rollers to be brought into contact with the ralling contact surface, carburized-quenched products of SCM420H with crowning R of 150 mm were used.

TABLE 4

| | | Component properties (after rntrocarburizing treatment) | | | | | | |
|---|---|---|---|---|---|---|---|---|
| No. | Nitro-carburizing treatment temperature (° C.) | Surface hardness HV | Effective hardened case depth (HV550) (mm) | Core hard-ness HV | Steel micro-structure | Bainite phase area ratio (%) | Number of repetitions up to roller damage × $10^3$ (2600MPa) | Remarks |
| 1 | 575 | 816 | 0.27 | 263 | Mainly B | 92 | 2534 | Example |
| 2 | 580 | 813 | 0.26 | 312 | Mainly B | 98 | 1936 | Example |
| 3 | 600 | 826 | 0.30 | 326 | Mainly B | 97 | 3132 | Example |
| 4 | 590 | 831 | 0.29 | 302 | Mainly B | 95 | 3080 | Example |
| 5 | 595 | 823 | 0.29 | 298 | Mainly B | 96 | 2663 | Example |
| 6 | 580 | 815 | 0.30 | 301 | Mainly B | 98 | 2673 | Example |
| 7 | 575 | 819 | 0.28 | 304 | Mainly B | 94 | 3122 | Example |
| 8 | 570 | 817 | 0.26 | 305 | Mainly B | 96 | 2360 | Example |
| 9 | 570 | 820 | 0.25 | 256 | Mainly B | 55 | 3056 | Example |
| 10 | 570 | 823 | 0.28 | 310 | Mainly B | 93 | 2858 | Example |
| 11 | 570 | 843 | 0.29 | 299 | Mainly B | 60 | 2826 | Example |
| 12 | 570 | 826 | 0.30 | 288 | Mainly B | 97 | 2332 | Example |
| 13 | 570 | 821 | 0.27 | 306 | Mainly B | 96 | 2944 | Example |
| 14 | 570 | 812 | 0.27 | 295 | Mainly B | 80 | 2305 | Example |
| 15 | 590 | 834 | 0.22 | 356 | Mainly B | 95 | 2592 | Example |
| 16 | 595 | 815 | 0.28 | 370 | Mainly B | 100 | 3025 | Example |
| 17 | 585 | 812 | 0.27 | 299 | Mainly B | 92 | 2942 | Example |
| 18 | 570 | 800 | 0.26 | 350 | Mainly B | 96 | 2672 | Example |
| 19 | 565 | 811 | 0.24 | 265 | Mainly B | 98 | 2251 | Example |
| 20 | 570 | 825 | 0.25 | 280 | Mainly B | 97 | 2289 | Example |
| 21 | 570 | 821 | 0.27 | 257 | Mainly B | 95 | 2930 | Example |
| 22 | 570 | 823 | 0.31 | 260 | Mainly B | 88 | 2997 | Example |
| 23 | 570 | 819 | 0.30 | 263 | Mainly B | 96 | 2837 | Example |
| 24 | 560 | 825 | 0.30 | 269 | Mainly B | 96 | 2663 | Example |
| 25 | 570 | 823 | 0.28 | 251 | Mainly B | 87 | 2766 | Example |
| 26 | 570 | 805 | 0.27 | 249 | Mainly B | 75 | 3246 | Example |
| 27 | 570 | 786 | 0.27 | 223 | F + P + B | 42 | 910 | Comparative Example |
| 28 | 570 | 789 | 0.27 | 205 | F + P + B | 24 | 884 | Comparative Example |
| 29 | 570 | 796 | 0.27 | 208 | F + P + B | 38 | 510 | Comparative Example |
| 30 | 570 | 803 | 0.28 | 216 | F + P + B | 45 | 576 | Comparative Example |
| 31 | 570 | 650 | 0.23 | 278 | F + P + B | 45 | 90 | Comparative Example |
| 32 | 570 | 812 | 0.28 | 401 | F + P + B | 24 | 340 | Comparative Example |
| 33 | 570 | 788 | 0.29 | 202 | F + P + B | 41 | 145 | Comparative Example |

TABLE 4-continued

| No. | Nitro-carburizing treatment temperature (° C.) | Component properties (after rntrocarburizing treatment) Surface hardness HV | Effective hardened case depth (HV550) (mm) | Core hard-ness HV | Steel micro-structure | Bainite phase area ratio (%) | Number of repetitions up to roller damage × $10^3$ (2600MPa) | Remarks |
|---|---|---|---|---|---|---|---|---|
| 34 | 570 | 801 | 0.26 | 215 | F + P + B | 48 | 345 | Comparative Example |
| 35 | 570 | 810 | 0.26 | 155 | F + B | 32 | 1120 | Comparative Example |
| 36 | 570 | 812 | 0.28 | 401 | Mainly B | 95 | 1376 | Comparative Example |
| 37 | 570 | 825 | 0.30 | 345 | Mainly B | 85 | 2247 | Comparative Example |
| 38 | 570 | 788 | 0.25 | 371 | F + P | 32 | 1976 | Comparative Example |
| 39 | 570 | 803 | 0.32 | 370 | M + B | 96 | 2951 | Comparative Example |
| 40 | 570 | 805 | 0.26 | 316 | Mainly B | 96 | 786 | Comparative Example |
| 41 | 570 | 814 | 0.27 | 301 | Mainly B | 95 | 347 | Comparative Example |
| 42 | 570 | 657 | 0.32 | 262 | F + P + B | 23 | 685 | Comparative Example |
| 43 | 570 | 825 | 0.12 | 398 | Tempered M + B | 56 | 61 | Comparative Example |
| 44 | 570 | 792 | 0.23 | 211 | F + P + B | 18 | 1127 | Comparative Example |
| 45 | 570 | 816 | 0.20 | 178 | Mainly B | 96 | 954 | Comparative Example |
| 46 | 570 | 810 | 0.14 | 326 | Mainly B | 97 | 37 | Comparative Example |
| 47 | 570 | 680 | 0.24 | 222 | Mainly B | 95 | 879 | Comparative Example |
| 48 | 570 | 810 | 0.25 | 295 | Mainly B | 96 | 1799 | Comparative Example |
| 49 | 570 | 702 | 0.14 | 321 | Mainly B | 94 | 22 | Comparative Example |
| 50 | 570 | 845 | 0.36 | 324 | Mainly B | 87 | 3128 | Comparative Example |
| 51 | 570 | 800 | 0.35 | 207 | Mainly B | 90 | 512 | Comparative Example |
| 52 | 570 | 804 | 0.17 | 275 | Mainly B | 94 | 71 | Comparative Example |
| 53 | 570 | 689 | 0.22 | 270 | Mainly B | 93 | 143 | Comparative Example |
| 54 | 570 | 816 | 0.24 | 272 | Mainly B | 90 | 375 | Comparative Example |
| 55 | —*3 | 730 | 1.02 | 344 | Tempered M | — | 3710 | Conventional Example |

*1Underlines indicate outside application range.

*2Symbols for microstructure represent the following phases: F: ferrite, P: pearlite, B: bainite, M: martensite

*3Carburizing treatment was performed.

The test results are shown in Table 4. Examples No. 1 to 26 are examples according to the present disclosure, No. 27 to 54 are comparative examples, and No. 55 is a conventional example produced by subjecting steel equivalent to JIS SCR420 to carburizing-quenching-tempering.

As is clear from Table 4, Examples No. 1 to 26 all had excellent tool life before nitrocarburizing treatment (i.e. as steel for nitrocarburizing treatment). Examples No. 1 to 26 all had slightly lower fatigue resistance than carburized-quenched-tempered Conventional Example No. 55 after nitrocarburizing treatment (equivalent to a nitrocarburized component), but exhibited excellent fatigue strength as a nitrocarburized material. In Examples No. 1 to 26, those with a nitrocarburizing treatment temperature of 560° C. all had an effective hardened case depth of 0.2 mm or more, although the description of detailed measurement results is omitted here. As a result of determining the composition of precipitates using an energy-dispersive X-ray spectrometer (EDX) as described above, 500 or more precipitates of Cr-based precipitates, V-based precipitates, and Nb-based precipitates with a particle size of less than 10 μm were dispersion-precipitated per unit area of 1 $m^2$ in all of Examples No. 1 to 26.

In Comparative Examples No. 27 to 54, the chemical composition or the resultant steel microstructure was outside the range according to the present disclosure, so that cracking occurred in continuous casting or fatigue resistance or machinability by cutting was poor.

In No. 27, the heating temperature in hot rolling was low. Consequently, precipitates formed during continuous casting did not dissolve sufficiently, and fatigue resistance after nitrocarburizing treatment was low. Besides, since the total microstructure proportion of ferrite and pearlite was high, machinability by cutting after hot rolling was low.

In No. 28, the hot rolling finish temperature was excessively low. Consequently, the proportion of bainite in the microstructure was low, and machinability by cutting was low. Besides, since the total microstructure proportion of ferrite and pearlite was high, the amounts of solute Cr, Nb, and V were small before nitrocarburizing treatment, as a result of which fine precipitates did not form after nitrocarburizing treatment, and fatigue resistance was low.

In No. 29 and 30, the cooling rate after hot rolling was low. Consequently, an appropriate amount of bainite was not obtained. Moreover, the amounts of solute Cr, Nb, and V were small before nitrocarburizing treatment, as a result of the amount of fine precipitates formed after nitrocarburizing treatment was small, causing insufficient strengthening by precipitation. Thus, fatigue resistance was low as compared with Examples. Machinability by cutting was also low.

In No. 31, the heating temperature in hot forging was low. Consequently, precipitate did not dissolve sufficiently, and fatigue resistance was low. Besides, since the total microstructure proportion of ferrite and pearlite was high, machinability by cutting after hot rolling was low.

In No. 32, the hot forging finish temperature was excessively low. Consequently, the proportion of bainite in the microstructure was low, and machinability by cutting was low. Besides, since the total microstructure proportion of ferrite and pearlite was high, the amounts of solute Cr, Nb, and V were small before nitrocarburizing treatment, as a result of which fine precipitates did not form after nitrocarburizing treatment, and fatigue resistance was low.

In No. 33 and 34, the cooling rate after hot forging was low. Consequently, an appropriate amount of bainite phase was not obtained. Moreover, the amounts of solute Cr, Nb, and V were small before nitrocarburizing treatment, and the amount of fine precipitates formed as a result of nitrocarburizing treatment was small, causing insufficient strengthening by precipitation. Thus, fatigue resistance was low as compared with Examples. Machinability by cutting was also low. In No. 35, the C content was less than the appropriate range, so that core hardness after nitrocarburizing treatment was low, and fatigue resistance was low as compared with Examples.

In No. 36, the C content was more than the appropriate range, so that the hardness of the hot forged material before nitrocarburizing treatment increased, causing low machinability by cutting.

In No. 37, the Si content was more than the appropriate range, so that the hardness of the hot forged material before nitriding treatment increased, causing low machinability by cutting.

In No. 38, the Mn content was less than the appropriate range, so that the steel microstructure of the hot forged material before nitrocarburizing treatment was mainly composed of ferrite phase and pearlite phase. Hence, V and Nb precipitates formed in the microstructure, as a result of which hardness before nitrocarburizing treatment increased, causing low machinability by cutting.

In No. 39, the Mn content was more than the appropriate range, so that cracking occurred in continuous casting. Moreover, martensite phase formed before nitrocarburizing treatment, causing low machinability by cutting.

In No. 40, the P content was more than the appropriate range, so that cracking occurred in continuous casting. Besides, fatigue resistance was low.

In No. 41, the S content was more than the appropriate range, so that cracking occurred in continuous casting. Besides, fatigue resistance was low.

In No. 42, the Cr content was less than the appropriate range, so that the steel microstructure of the hot forged material before nitrocarburizing treatment was mainly composed of ferrite phase and pearlite phase. Hence, coarse V and Nb precipitates formed in the microstructure, as a result of which hardness before nitrocarburizing treatment increased, causing low machinability by cutting. Moreover, the amounts of solute Cr, Nb, and V were small before nitrocarburizing treatment, and the amount of fine precipitates formed as a result of nitrocarburizing treatment was small, causing insufficient strengthening by precipitation. Thus, fatigue resistance was low as compared with Examples.

In No. 43, the Cr content was more than the appropriate range, so that cracking occurred in continuous casting. Besides, hardness after hot forging was high, causing low machinability by cutting.

In No. 44, the Mo content was less than the appropriate range. Accordingly, quench hardenability decreased, and the formation of bainite phase was insufficient. As a result, the amounts of Cr, Nb, and V were small before nitrocarburizing treatment, and the amount of fine precipitates formed as a result of nitrocarburizing treatment was small, causing insufficient strengthening by precipitation. Thus, fatigue resistance was low.

In No. 45, the V content was less than the appropriate range. Accordingly, the amount of solute V before nitrocarburizing treatment was small, and the amount of fine precipitates formed as a result of nitrocarburizing treatment was small, so that sufficient core hardness was not obtained. Thus, fatigue resistance was low.

In No. 46, the V content was more than the appropriate range, so that cracking occurred in continuous casting.

In No. 47, the Nb content was less than the appropriate range. Accordingly, the amount of solute Nb before nitrocarburizing treatment was small, and the amount of fine precipitates formed as a result of nitrocarburizing treatment was small, so that sufficient core hardness was not obtained. Thus, fatigue resistance was low.

In No. 48, the Nb content was more than the appropriate range, so that cracking occurred in continuous casting.

In No. 49, the Al content was less than the appropriate range. Accordingly, surface hardness after nitrocarburizing treatment was low, and fatigue resistance was low.

In No. 50, the Al content was more than the appropriate range, so that cracking occurred in continuous casting.

In No. 51, the N content was more than the appropriate range, so that cracking occurred in continuous casting.

In No. 52, Formula (1) was not satisfied, so that hardened case depth after nitrocarburizing treatment was shallow, and fatigue resistance was low.

In No. 53, Formula (1) was not satisfied, so that surface hardness after nitrocarburizing treatment was low, and fatigue resistance was low.

In No. 54, the Sb content was less than the appropriate range, so that cracking occurred in continuous casting.

The invention claimed is:

1. A steel for nitrocarburizing, comprising:

a chemical composition containing, in mass %,

C: 0.010% or more and 0.100% or less,

Si: 1.00% or less,

Mn: 0.50% or more and 3.00% or less,

P: 0.020% or less,

S: 0.060% or less,

Cr: 0.30% or more and 0.90% or less,

Mo: 0.005% or more and 0.200% or less,

V: 0.02% or more and 0.50% or less,

Nb: 0.003% or more and 0.150% or less,

Al: 0.005% or more and 0.200% or less,

N: 0.0200% or less,

Sb: 0.0005% or more and 0.0200% or less,

Ti: 0.1% or less, and one or more selected from the group consisting of:

W: 0.01% or more and 0.3% or less,

Co: 0.01% or more and 0.3% or less,

Hf: 0.01% or more and 0.2% or less, and

Zr: 0.01% or more and 0.2% or less, with the balance being Fe and inevitable impurities; and a steel microstructure in which an area ratio of bainite phase with respect to the entire microstructure is more than 50%, wherein the chemical composition satisfies the following Formula (1):

$$9.5 \leq ([Cr]/52+[V]/50.9+[Nb]/92.9+M) \times 10^3 \leq 18.5 \quad (1)$$

where M is a sum total of [W]/183.8, [Co]/58.9, [Hf]/178.5, [Zr]/91.2, and [Ti]/47.9, and parentheses [ ] represent a content of a corresponding element in the parentheses in mass %.

2. The steel for nitrocarburizing according to claim 1, wherein the chemical composition further contains, in mass %, one or more selected from the group consisting of B: 0.0100% or less, Cu: 0.3% or less, and Ni: 0.3% or less.

3. The steel for nitrocarburizing according to claim 2, wherein the chemical composition further contains, in mass %, one or more selected from the group consisting of Pb: 0.2% or less, Bi: 0.2% or less, Zn: 0.2% or less, and Sn: 0.2% or less.

4. A component comprising:
a core having the chemical composition and the steel microstructure according to claim 3; and
a surface layer having a chemical composition in which contents of nitrogen and carbon are higher than in the chemical composition of the core,
wherein Cr-containing precipitates, V-containing precipitates, and Nb-containing precipitates are dispersion-precipitated in the bainite phase.

5. The component according to claim 4, wherein the component has an effective hardened case depth with HV 550 of 0.2 mm or more.

6. A component comprising:
a core having the chemical composition and the steel microstructure according to claim 2; and
a surface layer having a chemical composition in which contents of nitrogen and carbon are higher than in the chemical composition of the core,
wherein Cr-containing precipitates, V-containing precipitates, and Nb-containing precipitates are dispersion-precipitated in the bainite phase.

7. The component according to claim 6, wherein the component has an effective hardened case depth with HV 550 of 0.2 mm or more.

8. The steel for nitrocarburizing according to claim 1, wherein the chemical composition further contains, in mass %, one or more selected from the group consisting of
Pb: 0.2% or less,
Bi: 0.2% or less,
Zn: 0.2% or less, and
Sn: 0.2% or less.

9. A component comprising:
a core having the chemical composition and the steel microstructure according to claim 8; and
a surface layer having a chemical composition in which contents of nitrogen and carbon are higher than in the chemical composition of the core,
wherein Cr-containing precipitates, V-containing precipitates, and Nb-containing precipitates are dispersion-precipitated in the bainite phase.

10. The component according to claim 9, wherein the component has an effective hardened case depth with HV 550 of 0.2 mm or more.

11. A component comprising:
a core having the chemical composition and the steel microstructure according to claim 1; and
a surface layer having a chemical composition in which contents of nitrogen and carbon are higher than in the chemical composition of the core,
wherein Cr-containing precipitates, V-containing precipitates, and Nb-containing precipitates are dispersion-precipitated in the bainite phase.

12. The component according to claim 11, wherein the component has an effective hardened case depth with HV 550 of 0.2 mm or more.

13. The steel for nitrocarburizing according to claim 1, wherein the chemical composition consists of, in mass %,
C: 0.010% or more and 0.100% or less,
Si: 1.00% or less,
Mn: 0.50% or more and 3.00% or less,
P: 0.020% or less,
S: 0.060% or less,
Cr: 0.32% or more and 0.65% or less,
Mo: 0.006% or more and 0.193% or less,
V: 0.02% or more and 0.50% or less,
Nb: 0.003% or more and 0.150% or less,
Al: 0.005% or more and 0.200% or less,
N: 0.0200% or less,
Sb: 0.0005% or more and 0.0200% or less,
Ti: 0.1% or less, and
one or more selected from the group consisting of:
W: 0.01% or more and 0.3% or less,
Co: 0.01% or more and 0.3% or less,
Hf: 0.01% or more and 0.2% or less, and
Zr: 0.01% or more and 0.2% or less,
optionally, one or more selected from the group consisting of:
B: 0.0100% or less,
Cu: 0.3% or less,
Ni: 0.3% or less,
Pb: 0.2% or less,
Bi: 0.2% or less,
Zn: 0.2% or less, and
Sn: 0.2% or less,
with the balance being Fe and inevitable impurities.

14. A component comprising:
a core having the chemical composition and the steel microstructure according to claim 13; and
a surface layer having a chemical composition in which contents of nitrogen and carbon are higher than in the chemical composition of the core,
wherein Cr-containing precipitates, V-containing precipitates, and Nb-containing precipitates are dispersion-precipitated in the bainite phase.

15. The component according to claim 14, wherein the component has an effective hardened case depth with HV 550 of 0.2 mm or more.

16. The steel for nitrocarburizing according to claim 1, wherein the chemical composition consists of, in mass %,
C: 0.011% or more and 0.098% or less,
Si: 0.02% or more and 1.00% or less,
Mn: 1.45% or more and 2.98% or less,
P: 0.008% or more and 0.018% or less,
S: 0.013% or more and 0.045% or less,
Cr: 0.32% or more and 0.65% or less,
Mo: 0.006% or more and 0.193% or less,
V: 0.04% or more and 0.45% or less,
Nb: 0.004% or more and 0.149% or less,
Al: 0.006% or more and 0.137% or less,
N: 0.0036% or more and 0.0192% or less,
Sb: 0.0005% or more and 0.0185% or less,
Ti: 0.1% or less, and
one or more selected from the group consisting of:
W: 0.01% or more and 0.3% or less,
Co: 0.01% or more and 0.3% or less,
Hf: 0.01% or more and 0.2% or less, and
Zr: 0.01% or more and 0.2% or less,
optionally, one or more selected from the group consisting of:
B: 0.0100% or less,
Cu: 0.3% or less,
Ni: 0.3% or less,
Pb: 0.2% or less,
Bi: 0.2% or less,
Zn: 0.2% or less, and
Sn: 0.2% or less,
with the balance being Fe and inevitable impurities.

17. A component comprising:
a core having the chemical composition and the steel microstructure according to claim 16; and
a surface layer having a chemical composition in which contents of nitrogen and carbon are higher than in the chemical composition of the core, wherein Cr-containing precipitates, V-containing precipitates, and Nb-containing precipitates are dispersion-precipitated in the bainite phase.

18. The component according to claim 17, wherein the component has an effective hardened case depth with HV 550 of 0.2 mm or more.

* * * * *